US009497545B1

(12) United States Patent
Keen et al.

(10) Patent No.: US 9,497,545 B1
(45) Date of Patent: Nov. 15, 2016

(54) ANALOG AREA SPEAKER PANEL WITH PRECISION PLACEMENT AND DIRECTION OF AUDIO RADIATION

(71) Applicant: International Business Machines Corporation, Armonk, NY (US)

(72) Inventors: Martin G. Keen, Cary, NC (US); David B. Lection, Raleigh, NC (US); John D. Wilson, League City, TX (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 14/994,449

(22) Filed: Jan. 13, 2016

(51) Int. Cl.

| | |
|---|---|
| ***H04R 25/00*** | (2006.01) |
| ***H04R 5/02*** | (2006.01) |
| ***H04S 3/00*** | (2006.01) |
| ***H04R 7/24*** | (2006.01) |
| ***H04R 9/06*** | (2006.01) |
| ***H04R 7/26*** | (2006.01) |
| ***H04R 1/24*** | (2006.01) |
| ***H04R 1/32*** | (2006.01) |
| ***H04R 1/42*** | (2006.01) |

(52) U.S. Cl.
CPC *H04R 5/02* (2013.01); *H04R 1/24* (2013.01); *H04R 1/323* (2013.01); *H04R 1/42* (2013.01); *H04R 7/24* (2013.01); *H04R 7/26* (2013.01); *H04R 9/063* (2013.01); *H04S 3/00* (2013.01); *H04R 2307/025* (2013.01)

(58) Field of Classification Search
CPC ..... H04R 1/24; H04R 1/42; H04R 1/323; H04R 5/02; H04R 7/24; H04R 7/26; H04R 9/063; H04S 3/00
USPC ..... 381/152, 191, 396, 431
See application file for complete search history.

(56) References Cited

U.S. PATENT DOCUMENTS

| | | | | |
|---|---|---|---|---|
| 7,570,774 | B2 | 8/2009 | Jeong et al. | |
| 7,787,645 | B2 * | 8/2010 | Clair | H04R 7/20 381/431 |
| 7,974,424 | B2 | 7/2011 | Kushida et al. | |
| 8,369,533 | B2 * | 2/2013 | Konagai | H04R 3/12 381/99 |
| 8,406,444 | B2 | 3/2013 | Wang | |
| 8,520,886 | B2 | 8/2013 | Wilk | |
| 8,620,017 | B2 | 12/2013 | Knonuma et al. | |

(Continued)

OTHER PUBLICATIONS

Jin, S. W. , et al., "Stretchable Loudspeaker using Liquid Metal Microchannel" Scientific Reports, Nature, Jul. 16, 2015, pp. 1-13.

(Continued)

*Primary Examiner* — Brian Ensey
(74) *Attorney, Agent, or Firm* — Cantor Colburn LLP; David Zwick

(57) ABSTRACT

A speaker includes an outer frame, a stretchable membrane material enclosed at least in part by the outer frame; a plurality of movable actuator devices disposed perpendicular to and on one side of the membrane material, each one of the actuator devices being connected to one side of the membrane material. The speaker also includes a controller configured to control creation of one or more radiating speaker elements at any selected instance in time and at corresponding one or more locations at the membrane material by controlling movement of a selected one or more of the movable actuator devices.

17 Claims, 5 Drawing Sheets

(56) References Cited

U.S. PATENT DOCUMENTS

| | | | |
|---|---|---|---|
| 9,100,749 | B2 | 8/2015 | Hartung et al. |
| 9,100,754 | B1 | 8/2015 | Pinkerton et al. |
| 2014/0193005 | A1 | 7/2014 | Riggs |
| 2014/0314268 | A1 | 10/2014 | Lazzari |
| 2015/0146911 | A1 | 5/2015 | Vieites et al. |
| 2015/0181341 | A1 | 6/2015 | Azmi |

OTHER PUBLICATIONS

Chen, X.L. , et al.," Analysis and Design of Mobile Device Antenna—Speaker Integration for Optimum Over-the-Air Performance", IEEE Antennas and Propagation Magazine, vol. 57, No. 1, Feb. 2015, pp. 1-13.

List of IBM Patents or Patent Applications Treated as Related; (Appendix P), Date Filed: Jan. 13, 2016, pp. 1-2.

Martin G. Keen, et al., Pending U.S. Appl. No. 14/994,467 entitled "Spatial Placement of Audio and Video Streams in a Dynamic Audio Video Display Device," filed with the U.S. Patent and Trademark Office on Jan. 13, 2016.

* cited by examiner

ANALOG AREA SPEAKER PANEL WITH PRECISION PLACEMENT AND DIRECTION OF AUDIO RADIATION

BACKGROUND

The present invention relates to audio speakers, and more specifically, to an analog audio speaker panel with dynamically formed radiating speaker elements at various user-defined locations on the panel.

Audio reproduction systems have evolved relatively significantly over the years from a single speaker system that produced monaural sound, to a pair of speakers that produced stereo sound, to quadraphonic audio speaker systems, to the present-day 5.1 and 11.2 speaker arrangements. The constant driving force has been to more accurately reproduce sound in a spatial manner.

SUMMARY

According to an embodiment of the present invention, a speaker includes an outer frame, a stretchable membrane material enclosed at least in part by the outer frame; a plurality of movable actuator devices disposed perpendicular to and on one side of the membrane material, each one of the actuator devices being connected to one side of the membrane material. The speaker also includes a controller configured to control creation of one or more radiating speaker elements at any selected instance in time and at corresponding one or more locations at the membrane material by controlling movement of a selected one or more of the movable actuator devices.

According to another embodiment of the present invention, a speaker includes a panel including a rigid outer frame and a sheet of membrane material enclosed at least in part by the outer frame, and a plurality of movable actuator devices disposed on one side of the membrane material, each one of the movable actuator devices being connected to one side of the membrane material. The speaker also includes a controller configured to control creation of one or more radiating speaker elements at any selected instance in time and at corresponding one or more locations at the membrane material by controlling movement of a selected one or more of the movable actuator devices.

According to yet another embodiment of the present invention, a speaker includes membrane material, and a plurality of movable actuator devices disposed perpendicular to and on one side of the membrane material. The speaker also includes a controller configured to control creation of one or more radiating speaker elements at any selected instance in time and at corresponding one or more locations at the membrane material by controlling movement of a selected one or more of the movable actuator devices.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

FIG. 3, including

DETAILED DESCRIPTION

Typical modern audio speakers contain three primary components that together generate the audio sound from the speaker: a magnet, a voice coil, and a cone. The coil is attached to the cone, which is in proximity to the magnet. The coil, when energized with electrical current, vibrates which, in turn, causes the cone to vibrate and produce audio sound.

Traditional audio speakers are typically statically mounted in place (i.e., they do not move unless the user physically moves them to another location), when these speakers reproduce audio at a particular location in a room (i.e., not at a speaker location per se, but a location such as where a listener is located), the sound reproduction is only approximate. This is because the audio reproduction is based on the distance of the speaker to the specific location in the room, and on the proximity of the one or more speakers to that location.

Also, modern speaker systems require a relatively large number of speakers (i.e., six speakers for a "5.1" speaker system, and thirteen speakers for an "11.2" speaker system) to be statically mounted. This involves detailed wiring or wireless placement of the individual or separate speakers in an attempt to achieve a desired sound quality. In addition, when upgrading the speaker system to a newer system (e.g., theoretically a "13.3" system), this requires adding two more separate speakers and a separate subwoofer to an existing "11.2" system, and also rewiring and/or repositioning some or all of the speakers to accommodate the new spatial distribution of the speakers in an attempt to achieve a desired sound quality.

In contrast, in embodiments of the present invention, the analog area speaker ("AAS") contains somewhat similar functional elements as the typical modern speaker mentioned hereinabove. However, in accordance with embodiments of the present invention and as described and illustrated in more detail hereinafter, the elements of the analog area speaker are formed dynamically within some defined physical area on or within a panel such that the speaker so formed is not limited per se to a fixed spatial location within the defined physical area in a manner hereinbefore described with respect to the typical modern speaker.

Figure 1:
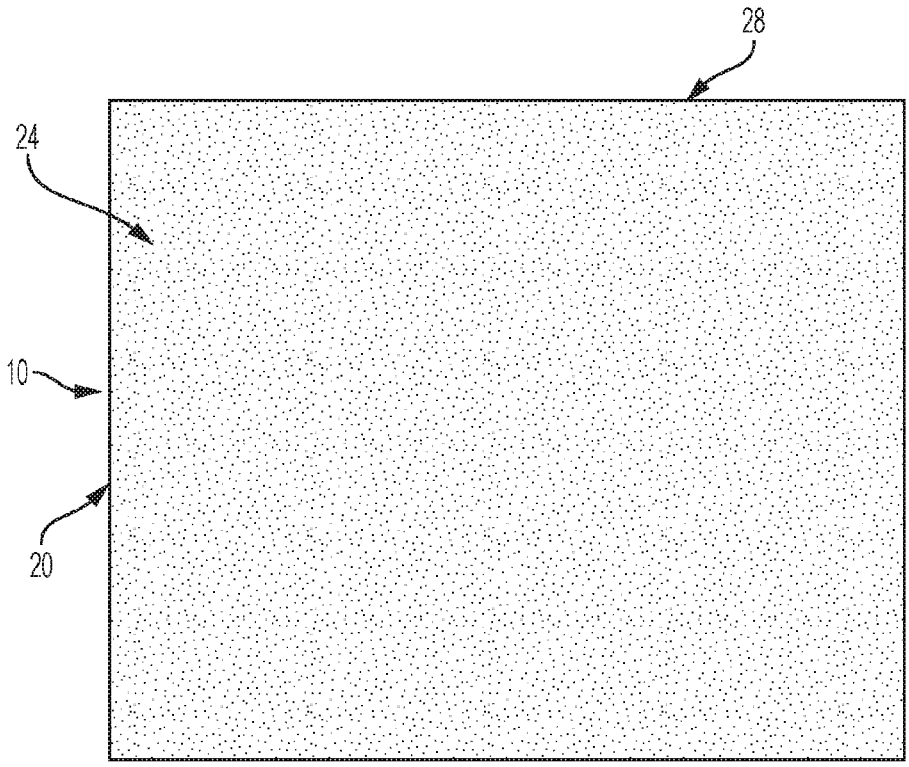
FIG. 1 is a front view of a panel portion of an analog area speaker in accordance with an embodiment of the present invention.

With reference now to FIG. 1, there illustrated is an analog area speaker 10 of various embodiments of the present invention. The AAS 10 may comprise a panel or wall element 20. The AAS panel 20 may comprise a generally flat sheet of membrane material 24 surrounded or enclosed (at least in part) by an outer frame 28. In embodiments of the present invention, the panel 20 may be of any shape; for example, square, rectangular, or circular. The panel 20 may also be oriented entirely vertically within a physical spatial location (e.g., a room in a house), or it may be at some other spatial orientation, such as tilted at an angle with respect to a vertical axis. The panel 20 may also be of any desired size; for example, the panel 20 may occupy a small portion (e.g., two feet by two feet) of a room or the panel 20 may occupy an entire wall of a room. Also, more than one AAS 10 may be located in a single room (e.g., on opposite or perpendicular walls) or in other spatial areas. As described in detail hereinafter with respect to FIG. 5, a controller 80 may be used to control a single AAS 10, or the controller 80 may control more than one AAS 10.

In accordance with embodiments of the present invention, the membrane material 24 comprising the AAS panel 20 may be a stretchable or flexible membrane material such as a polyester sheet or plastic film (e.g., Mylar®). As described and illustrated in more detail hereinafter, the type of material selected for the panel membrane material 24 may be based on its ability to deform by a suitable amount due to a pressure applied to the membrane material 24 at particular locations thereof. This deformation by an applied pressure is what dynamically forms a radiating speaker element in accordance with the analog area speaker of embodiments of the present invention.

The outer frame 28 may comprise any suitable type of rigid material, such as wood, metal, plastic, etc. The primary function of the outer frame 28 is to hold the membrane material 24 of the panel 20 securely in place during the deformations that take place within the membrane material 24 when radiating speaker elements are formed in a dynamic manner, in accordance with embodiments of the present invention.

Figure 2:
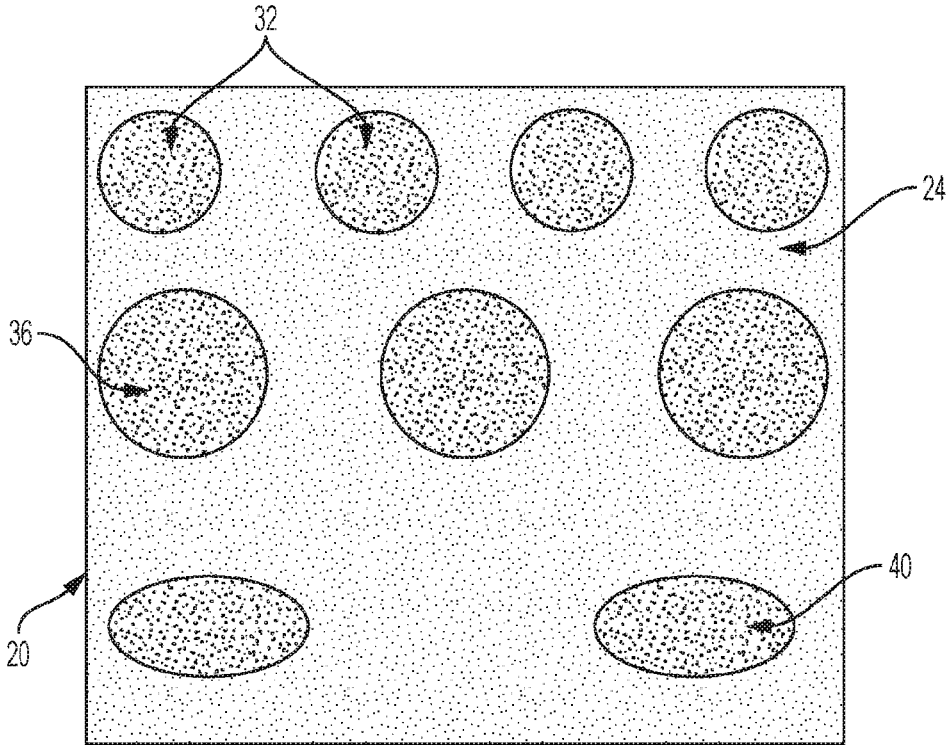
FIG. 2 is a front view of the panel portion of FIG. 1 having a number of radiating speaker elements formed therein in accordance with an embodiment of the present invention.

In FIG. 2 is illustrated a front view of the panel 20 of the AAS 10 of FIG. 1 having circular elements 32, larger circular elements 36, and oval elements 40 dynamically formed in the panel's membrane material 24 within corresponding horizontal rows in accordance with an embodiment of the present invention. As will be discussed in detail hereinafter, the RSE's 32, 36, 40 are formed in the membrane material 24 by deformations of the material 24 in select locations by applying pressure to the membrane 24 in those select locations.

It should be understood that the shapes and sizes of the RSE's 32, 36, 40 shown in FIG. 2 are purely exemplary. The RSE's may take on any suitable shape and/or size in light of the teachings herein. Also, all of the RSE's 32, 36, 40 formed in the AAS panel 20 may have the same shape and size, or may have any number of different shapes and/or sizes formed in the panel 20. In accordance with embodiments of the present invention, at any given moment in time the number of RSE's dynamically formed, and their size, shape and location on the panel 20 may be based primarily on the audio sound spatial field desired to be produced or rendered by the RSE's 32, 36, 40 within the spatial location of the AAS 10 in the room or other area in which the AAS 10 is located.

Figure 3B:
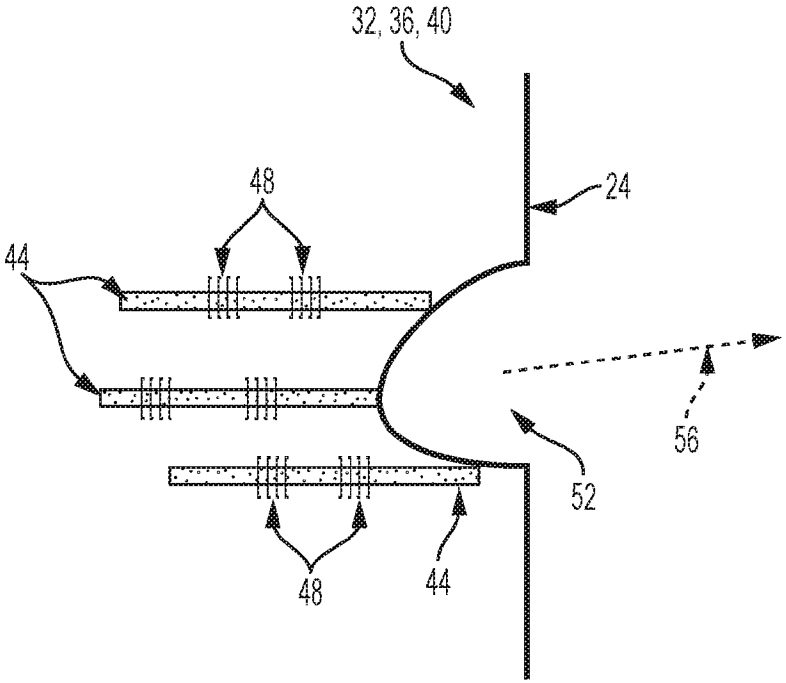
FIGS. 3A and 3B, show side views of two different embodiments of a radiating speaker element in accordance with the present invention.
Figure 3A:
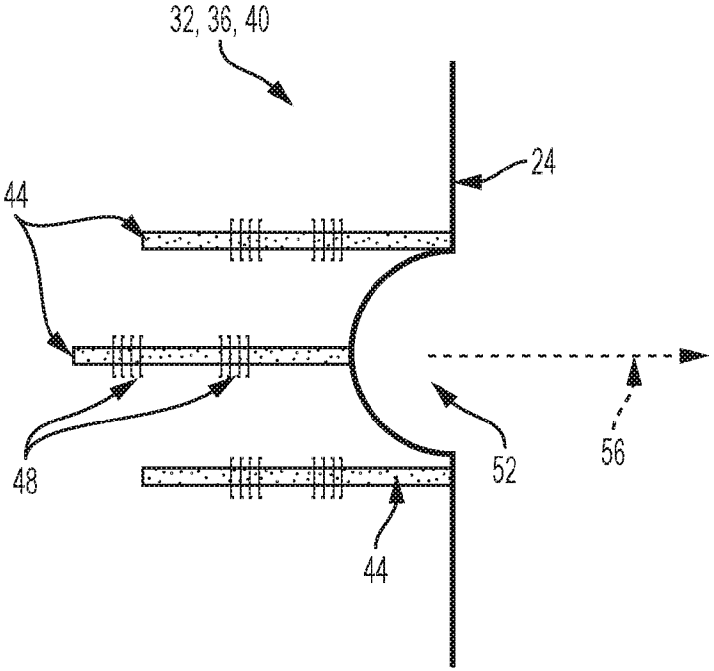

Referring now to FIG. 3A, there illustrated is a side view of a radiating speaker element ("RSE") 32, 36, 40 in accordance with embodiments of the present invention. Typically an analog area speaker ("AAS") 10 of embodiments of the present invention will have a plurality of similar such RSE's that may be arranged in a grid-like, two-dimensional pattern (i.e., rows and columns) within the AAS panel 20. In the alternative, the plurality of RSE's may be arranged randomly throughout the AAS panel 20.

Each RSE 32, 36, 40 may have three movable actuator or driver pins 44 located behind or to the left side of the membrane 24 and disposed perpendicular thereto, as shown in FIGS. 3A and 3B. However, it is to be understood that each RSE may have at least one pin 44 associated with it, or may have any number of pins 44 greater than one associated with it. Each actuator or driver pin 44 may comprise a ferrous magnetic material, or other suitable material. One end of each pin 44 is connected to the left side of the membrane 24. In addition, each pin 44 has an electrically actuated coil of wire 48 wrapped or disposed around at least a portion of the pin 44. Electrical current flows through selected ones of the wire coils 48 at various times. The electrically actuated wire coils 48 thereby form electromagnets. When energized, the electromagnetic coils 48 cause actuation or "driving" movement of the corresponding pins 44; for example, linearly, to the left (i.e., pulling or negative movement) or the right (i.e., pushing or positive movement) in FIGS. 3A and 3B. Such movement of the pins 44 causes the portion of the membrane 24 connected to the corresponding moving pin 44 to deform either inward (i.e., pulled to the left in FIGS. 3A and 3B) or outward (i.e., pushed to the right in FIGS. 3A and 3B). Note that the movement of the actuator or driver pins 44 may be something other than linear.

Thus, by moving (i.e., modulating) the actuator pin 44 in the center of either FIG. 3A or FIG. 3B back and forth (i.e., the center pin 44 is located in between the two other pins 44 that flank the center pin 44 on either side), a speaker cone 52 is dynamically formed at any desired instant in time within the membrane material 24 at the location of this center pin 44. Sound can then be reproduced by such a moving cone (i.e., transducer) 52 at the dynamic location on the AAS panel 20.

Also, while a center actuator "driver" pin 44 is being actuated while dynamically forming an RSE, the other two actuator pins 44 flanking the center "driver" actuator pin 44 may be held in place by a biasing voltage. That way the two outer flanking actuator pins 44 help to "frame" or "fix" the outer rim of the cone of the dynamically formed radiating speaker element. Further, in various embodiments of the present invention, if two outer or flanking "fixing" actuator pins 44 are utilized with a center "driver" actuator pin 44, then a cone with an approximate rectangular shape may be formed in the membrane material 24 on the AAS panel 20. The rectangular shaped cone may have different characteristics (e.g., produces relatively more directional sound). Typically, the greater number of outer or "fixing" actuator pins 44 used to dynamically form the radiating speaker element, then the relatively more "open" the cone may be. Thus, a relatively wider sound dispersal may be achieved.

Relatively larger cones 52 may be dynamically formed for reproducing lower frequencies (e.g., a subwoofer), while relatively smaller cones 52 may be dynamically formed for reproducing higher frequencies. The lines 56 with the arrowheads in FIGS. 3A and 3B indicate the direction of the sound as radiates out from the dynamically formed speaker cones 52. FIG. 3A illustrates the sound coming out of the cone 52 in essentially a horizontal direction (i.e., essentially perpendicular to the plane of the membrane material 24). This is accomplished by not only moving the center actuator pin 44 as described, but also by keeping the two pins 44 that flank the center pin stationary (e.g., by an applied biasing voltage), thereby keeping the membrane material 24 stationary at the locations of the outer two flanking pins.

In the embodiment of the RSE 32, 36, 40 of FIG. 3B, all three of the pins 44, or at least two of the pins 44, are caused to move as described hereinabove (i.e., by electrically actuating their corresponding wire coils 48). The pins 44 may be caused to move at differing linear amounts. In the embodiment shown in FIG. 3B, the upper pin 44 moves inward to a relatively greater extent than the lower pin 44. This causes the sound coming out of the cone 52 to be angled or skewed upward, as indicated by the line 56 with the arrowhead in FIG. 3B.

In alternatives, the sound coming out of any one of the cones 52 may be aimed in any conical position from the front of the membrane 24. The conical position may be typically limited in practice by the available amount of linear travel of the pins 44 associated with the cone 52. Thus, by selectively actuating one or more of the pins 44 associated with a dynamically formed RSE at varying amounts of linear travel, the spatial direction of the sound emanating from the RSE can be made to vary relatively precisely. That way a user of the AAS 10 of embodiments of the present invention may specifically direct the desired locations of the sound within the room or other spatial area in which the AAS 10 is located.

In light of the foregoing, the circles 32, 36 and the ovals 40 shown in FIG. 2 mark the locations on the membrane material 24 on the AAS panel 20 where the speaker cones may be dynamically formed at varying instances in time in accordance with embodiments of the present invention. More specifically, in accordance with embodiments of the present invention, at any instant in time one or more of the RSE's may be dynamically formed to produce audio sound. Then at another instant in time, one or more of the same RSE's and/or different RSE's may be dynamically formed, with possibly differing sizes of the RSE's, thereby producing differing frequencies of sound at varying locations within the AAS panel 20. In essence, the audio sound field created by the AAS 10 may be moved over time to varying locations within the AAS panel 20.

Figure 4:
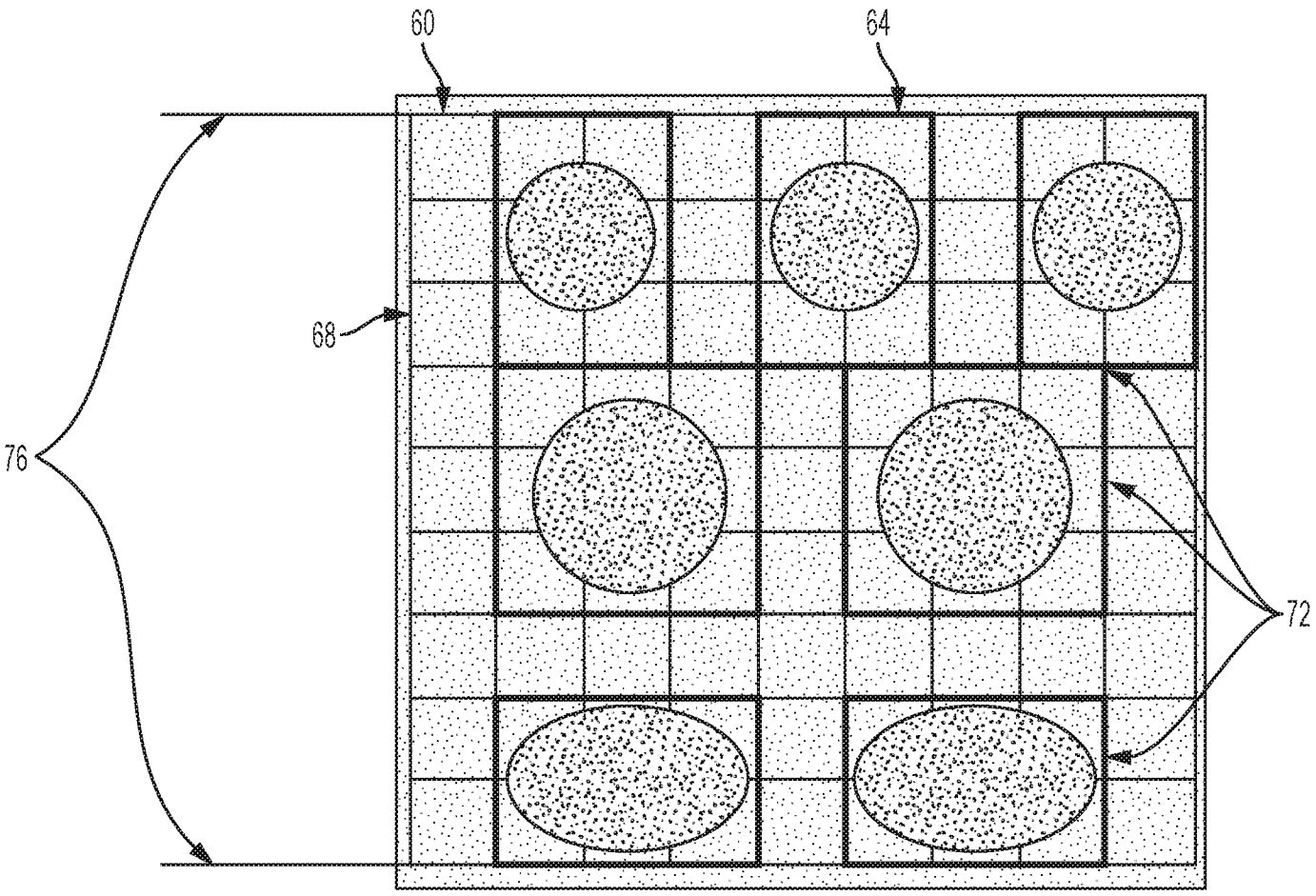
FIG. 4 is a front view of the analog area speaker of FIG. 1 having an internal frame in accordance with an embodiment of the present invention.

Referring now to FIG. 4, there illustrated is the AAS panel 20 having an additional internal damping frame 60. The purposed of the damping frame 60 is to provide damping or prevention of any audio crosstalk between the dynamically formed radiating speaker elements ("RSE's") 32, 36, 40 in the AAS panel 20.

In embodiments of the present invention, the internal damping frame 60 may comprise a two-dimensional grid-like structure comprising a number of both horizontal elements 64 and vertical elements 68, as shown in FIG. 4. However, it is to be understood that arranging the elements 64, 68 horizontally and vertically is purely exemplary. Other arrangements of the elements 64, 68 (e.g., angular) are possible. The horizontal and vertical elements 64, 68 may comprise enclosed channels that contain microfluids, wherein the enclosed channels 64, 68 may be selectively pressurized by pressurizing the microfluids therein. The enclosed channels 64, 68 of the internal damping frame 60 may be formed integral with the membrane material 24, for example, next to a surface of the membrane material 24 (e.g., the same surface or side of the membrane material that the pins 44 are in contact with), between layers of the membrane material 24, or inside or within the membrane material 24. It suffices that the enclosed channels 64, 68 are disposed in proximity to the membrane material 24.

Portions of the channels may be selectively pressurized in the form of a frame 72 or relatively rigid border surrounding an RSE that is dynamically formed at the same time. Each frame 72 may be formed by selectively opening and closing valves located within the frame 60 at the intersections of the horizontal and vertical channels 64, 68. In the alternative, the valves may be located elsewhere with respect to the channels 64, 68. The channels 64, 68 may be selectively pressurized by providing a fluid pressure across the inputs 76 of the internal damping frame 60. This fluid pressure may be applied by any type of pressurizing device (not shown).

When the channels 64, 68 are selectively pressurized to form the damping frames 72, the frames stiffen the membrane material 24 at its edges, thereby damping the propagation of vibrations from the dynamically formed RSE. Thus, at the same time that an RSE 32, 36, 40 is dynamically formed in the AAS 10, a pressurized frame 72 is also dynamically formed in the AAS 10. FIG. 4 illustrates a number of such frames 72.

In other embodiments of the present invention, instead of the internal damping frame 60 comprising the fluidic channels 64, 68 and associated hardware (e.g., valves, applied input pressure), an electroactive polymer material (either of the dielectric type or the ionic type) may be utilized as part of the internal damping frame 60. Specifically, at the locations of the fluidic channels in the grid of the internal damping frame 60, strips of the electroactive polymer material may instead be attached to the membrane material 24 (e.g., polyester or plastic film). A voltage may then be applied to the portions of the strips of electroactive polymer material at which it is desired to form a frame around an RSE 32, 36, 40. The applied voltage causes the electroactive polymer material in the strips to become rigid or stiffen, which results in a frame 72 surrounding the RSE, in a manner similar to the frames 72 formed by the microfluidic channels discussed hereinabove. The voltage may be applied by a voltage device (not shown) at the inputs 76 of the internal damping frame, similar to the microfluid channel embodiment discussed above in which a fluid was applied across the inputs 76 of the internal damping frame 60. In the alternative, the voltage may be selectively applied directly to the portions of the strips of electroactive polymer material instead of at the inputs 76 of the internal damping frame 60.

Figure 5:
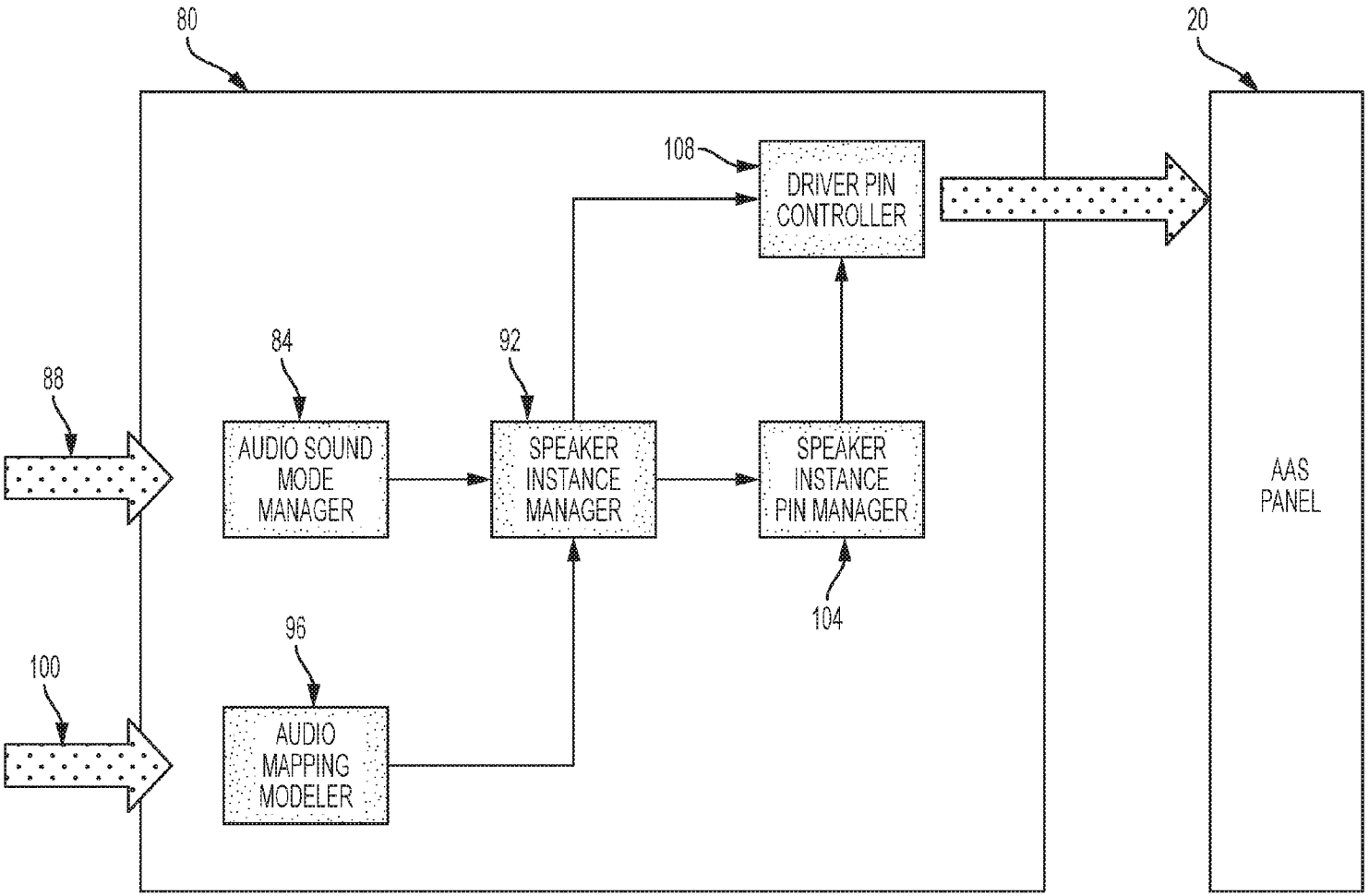
FIG. 5 is a block diagram of a controller for the analog area speaker of FIG. 1 in accordance with an embodiment of the present invention.

Referring now to FIG. 5, there illustrated is a block diagram of a controller 80 for the analog area speaker 10 of FIG. 1 in accordance with an embodiment of the present invention. The controller 80 may form a part of the analog area speaker 10 in that the controller 80 may be physically located at, on, or within the analog area speaker 10. In the alternative, the controller 80 may be located separate and apart from the AAS 10. Further, in various embodiments, the controller 80 may comprise electronic and/or electrical components, such as, for example, one or more processors that are wired or programmed to control the sound provided by the AAS 10.

In accordance with embodiments of the present invention, the controller 80 may be utilized with one or more analog area speakers 10. For example, in an embodiment using two AAS's 10 (one AAS 10 located in the front of a room and another AAS 10 located in the back of a room), the controller 80 may map a "5.1" audio signal by providing the left front, right front and center speakers on one AAS 10, and the left rear, right rear and sub-woofer on the other AAS 10. This setup is purely exemplary, and somewhat "mirrors" how someone would place traditional "static" speakers within a room to achieve a "5.1" setup. Note that with the AAS 10 of embodiments of the present invention, a user can precisely dynamically locate a radiating speaker element ("RSE") on an AAS panel 20 out of the way of any obstacle (e.g., furniture) that may be blocking a portion of the AAS panel 20.

In an exemplary embodiment, the controller 80 may include an audio sound mode manager module 84. This module 84 may accept an input on a signal line 88 with respect to the audio sound mode desired. The input 88 may be a traditional type of desired sound to be produced by the AAS 10, such as for example, "mono," "stereo," "5.1," "7.1," etc. However, the input 88 to the audio sound mode manager module 84 may be relatively more complex, such as, for example, an input 88 that defines instances of radiating speaker elements ("RSE's") 32, 36, 40 to be formed of certain sizes, at certain times, at certain angles of sound radiation with respect to the AAS panel 20, and at particular locations on the AAS panel 20.

A speaker "instance" may be considered to be when a single speaker is dynamically created on the AAS panel 20 in embodiments of the present invention. The speaker instance may be thought as being created both physically and logically. Each speaker so created has an origin location in x/y coordinates on the AAS panel 20. Each speaker also has a size DX/DY; that is, how big the speaker is on the AAS panel 20 in units of measurement (e.g., millimeters). Thus, at any instant or moment in time, there are N speaker instances that are created on the AAS panel 20, in accordance with embodiments of the present invention. Of course, with zero ("0") speaker instances at any instant in time, there is no sound being reproduced by the AAS 10 at that instant in time.

The audio sound mode manager module 84 accepts the desired sound mode information on the input 88 and determines the number of speaker instances required, their sizes, and other pertinent information regarding the RSE's to be dynamically created and sends this information to a speaker instance manager module 92 for processing. The desired sound mode information on the input signal line 88 may be provided by some type of computer or processing device, or an audio device such as a receiver (not shown).

In an embodiment of the present invention, the speaker instance manager 92 manages a data structure (e.g., a table) containing a number of speaker instances over a period of time. For each speaker instance, the table lists the x and y coordinates of each speaker instance and the size, DX, DY, of each speaker instance. The speaker instance manager 92 passes through the analog audio signals on the lines 100 to the speaker instance pin manager to calculate the composite voltages applied to the electromagnets for each pin the given speaker instance. This is done in real time, and as the pin voltages vary, the cone moves in and out, producing sound.

The controller 80 may also include an audio mapping modeler module 96 that accepts the analog audio signals on signal lines 100 and assigns those signals 100 to the speaker instance, using the speaker instance manager module 92, as defined when the audio sound mode is setup. For example, if a stereo setup is created, then the audio mapping modeler module 96 assigns the left analog stereo sound signal to the left most speaker element (i.e., one of the RSE's), and assigns the right analog stereo sound signal to the right most speaker (i.e., another one of the RSE's). Similar to the desired sound mode information on the input signal line 88, the analog audio signals on the signal lines 100 may be provided by some type of computer or processing device, or an audio device such as a receiver (not shown). This device would be one that has some knowledge of the audio signals to be presented, and how they should be rendered as sound by the AAS 10. Further, this device may function to associate the speaker pattern to the audio signal.

The speaker instance manager 92 passes through the analog audio signals on the lines 100 to the speaker instance pin manager to calculate the composite voltages applied to the electromagnets for each pin 44 the given speaker instance. This is done in real time, and as the pin voltages vary, the cone moves in and out, producing sound.

The controller 80 may also include a speaker instance pin manager module 104 that may determine the array of driver or actuator pins 44 for a given speaker instance, based on the location, and size of the speaker instance. A driver pin data structure ("DPDS") that maps the addresses of the driver pin area on the AAS panel 20 may be passed to a driver pin controller module 108 for bias and signal processing. For each DPDS that is passed to the driver pin controller module 108, the driver pin controller module 108 may determine in real-time the absolute value of the DC voltage to be applied to each driver pin 44 (FIGS. 3A and 3B) in the DPDS. This information is communicated to the AAS in real-time to drive each created radiating speaker element 32, 36, 40. The voltage for each pin 44 may be determined as a composite voltage that comprises a DC bias component that sets the position of the driver pin and an A/C audio signal component. A collection of driver pins 44 properly biased will form a cone by pulling and stretching the membrane material 24 into a circular (or other shape) shallow cone. As the A/C audio signal is applied to each pin 44, the pin voltage is increased causing the pin 44 to retract further into the electromagnetic actuator, and pulling the membrane material 24 deeper (i.e., to the left in FIGS. 3A and 3B), or the pin voltage is decreased, allowing the pin 44 to relax and the membrane material to return to original shape (i.e., pushed to the right in FIGS. 3A and 3B). This movement of the pins 44 in and out in unison allows the radiating speaker element 32, 36, 40 to push the ambient air, producing sound.

The driver pin controller module 108 may also be used to determine the voltage to be applied to the inputs 76 of the internal damping frame in the embodiment where the internal damping frame 60 comprises strips of electroactive polymer material or where the voltage is applied directly to the selected strips of electroactive polymer material such that the strips become rigid and form a frame 72 around a dynamically formed RSE.

Other embodiments of the present invention may utilize a different type of controller 80 to interface with the AAS 10. For example, a combination of the MPEG-7 interface specification and the spatial placement of objects supported in a VRML stream within an MPEG-7 system may be utilized. Broadly speaking, any controller that expresses the full definition of not only the character of the sound itself, but also the direction and radiation pattern of the sound may be used with embodiments of the AAS 10 of the present invention.

In other embodiments of the analog area speaker 10, relatively small radiating speaker elements may be constructed for use in headphones. This may allow for dynamic reconfiguration of a set of headphones to match the channel characteristics of the audio output. For example, with a standard 2.0 channel signal, only one or two RSE's would need to be formed in each ear cup of the headphones. Also, for a 5.1 surround sound signal, two RSE drivers for each front and rear channel in each ear cup may be formed, along with a bass radiator and center channel RSE's in each ear cup. Other configurations should be apparent in light of these teachings herein.

Other embodiments of the analog area speakers 10 and radiating speaker elements 32, 36, 40 of the present invention support installations on the floor and/or ceiling of a room. As such, the radiation patterns of the AAS's 10 mounted in these locations would need to be coordinated with any wall speakers. That way, all of the AAS's 10 in the installation work properly together, producing correctly phased audio signals for the listeners in the room.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A speaker comprising:

an outer frame;

a stretchable membrane material enclosed at least in part by the outer frame;

a plurality of movable actuator devices disposed perpendicular to and on one side of the membrane material, each one of the actuator devices being connected to one side of the membrane material;

a controller configured to control creation of one or more radiating speaker elements at any selected instance in time and at corresponding one or more locations at the membrane material by controlling movement of a selected one or more of the movable actuator devices; and an internal frame disposed in proximity to the membrane material, wherein the internal frame is controlled such that portions of the internal frame surrounding the corresponding one or more created radiating speaker elements at any selected instance in time become rigid, thereby damping any vibrations that may originate from the one or more created radiating speaker elements.

2. The speaker of claim 1, wherein the movement of a selected one or more of the movable actuator devices causes a portion of the membrane material connected to the one or more of the movable actuator devices undergoing movement to form a speaker cone that produces sound in response to an applied audio signal to the selected one or more of the movable actuator devices undergoing movement.

3. The speaker of claim 1, wherein each one of the plurality of moveable actuator devices comprises a ferrous metal actuator pin and a wire coil, the wire coil surrounding at least a portion of the actuator pin.

4. The speaker of claim 1, wherein the internal frame comprises an array of microfluidic channels containing a fluid, wherein portions of the microfluidic channels surrounding the corresponding one or more created radiating speaker elements at any selected instance in time are selectively pressurized causing the portions of the microfluidic channels surrounding the corresponding one or more created radiating speaker elements at any selected instance in time to become rigid, thereby damping any vibrations that may originate from the one or more created radiating speaker elements.

5. The speaker of claim 1, wherein the internal frame comprises an array of electroactive polymer material strips, wherein portions of the electroactive polymer strips surrounding the corresponding one or more created radiating speaker elements at any selected instance in time are selectively made rigid by application of a voltage thereto, thereby damping any vibrations that may originate from the one or more created radiating speaker elements.

6. The speaker of claim 1, wherein the membrane material is from the group comprising a plastic or a polymer film.

7. The speaker of claim 2, wherein the controller is configured to control movement of a selected one or more of the movable actuator devices such that the sound produced from the speaker cone is at a certain direction with respect to the membrane material.

8. The speaker of claim 2, wherein the speaker cone that produces sound is formed with a particular shape and size, thereby affecting a frequency of sound produced by the speaker cone.

9. A speaker comprising:

a panel including a rigid outer frame and a sheet of membrane material enclosed at least in part by the outer frame;

a plurality of movable actuator devices disposed on one side of the membrane material, each one of the movable actuator devices being connected to one side of the membrane material;

a controller configured to control creation of one or more radiating speaker elements at any selected instance in time and at corresponding one or more locations at the membrane material by controlling movement of a selected one or more of the movable actuator devices; and an internal frame disposed in proximity to the membrane material, wherein the internal frame is controlled such that portions of the internal frame surrounding the corresponding one or more created radiating speaker elements at any selected instance in time become rigid, thereby damping any vibrations that may originate from the one or more created radiating speaker elements.

10. The speaker of claim 9, wherein the movement of a selected one or more of the movable actuator devices causes a portion of the membrane material in contact with the one or more movable actuator devices undergoing movement to form a speaker cone that produces sound in response to an applied audio signal to the selected one or more of the movable actuator devices undergoing movement.

11. The speaker of claim 9, wherein each one of the plurality of moveable actuator devices comprises a ferrous metal actuator pin and a wire coil, the wire coil surrounding at least a portion of the actuator pin.

12. The speaker of claim 9, wherein the sheet of membrane material is flexible or stretchable and is from the group comprising a plastic or a polymer film.

13. The speaker of claim 10, wherein the controller is configured to control movement of a selected one or more of the movable actuator devices such that the sound produced from the speaker cone is at a certain direction with respect to the sheet of membrane material.

14. The speaker of claim 10, wherein the speaker cone that produces sound is formed with a particular shape and size, thereby affecting a frequency of sound produced by the speaker cone.

15. A speaker comprising:

membrane material;

a plurality of movable actuator devices disposed perpendicular to and on one side of the membrane material;

a controller configured to control creation of one or more radiating speaker elements at any selected instance in time and at corresponding one or more locations at the membrane material by controlling movement of a selected one or more of the movable actuator devices; and an internal frame disposed in proximity to the membrane material, wherein the internal frame is controlled such that portions of the internal frame surrounding the corresponding one or more created radiating speaker elements at any selected instance in time become rigid, thereby damping any vibrations that may originate from the one or more created radiating speaker elements.

16. The speaker of claim 15, wherein the movement of a selected one or more of the movable actuator devices causes a portion of the membrane material in contact with the one or more movable actuator devices undergoing movement to form a speaker cone that produces sound in response to an applied audio signal to the selected one or more of the movable actuator devices undergoing movement.

17. The speaker of claim 15, wherein the membrane material is enclosed at least in part by an outer frame, and wherein the membrane material comprises a sheet of stretchable material from the group comprising a plastic or a polymer film.

* * * * *